US005883934A

United States Patent [19]

Umeda

[11] Patent Number: 5,883,934

[45] Date of Patent: Mar. 16, 1999

[54] METHOD AND APPARATUS FOR CONTROLLING IONS

[75] Inventor: Teruhiko Umeda, Nagoya, Japan

[73] Assignee: Yuugengaisya Youzen, Aichi, Japan

[21] Appl. No.: 784,235

[22] Filed: Jan. 16, 1997

[30] Foreign Application Priority Data

Jan. 16, 1996 [JP] Japan ..... 8-035341
Nov. 1, 1996 [JP] Japan ..... 8-327475

[51] Int. Cl.[6] ..... H05F 3/06

[52] U.S. Cl. ..... 378/64; 361/213

[58] Field of Search ..... 378/64, 66; 361/21, 361/213, 227, 330, 231, 235

[56] References Cited

U.S. PATENT DOCUMENTS 2,723,349 11/1955 Rylsky .
2,785,312 3/1957 Martin, Jr. .
4,827,371 5/1989 Yost ..... 361/213
4,829,398 5/1989 Wilson ..... 361/213
5,750,011 5/1998 Ohmi et al. ..... 361/213 X

*Primary Examiner*—David P. Porta
*Attorney, Agent, or Firm*—Koda & Androlia

[57] ABSTRACT

An ion control method and apparatus in which positive ions and negative ions are generated by irradiating an X-ray in a particular space, and the ratio of positive and negative ions generated is controlled by changing the polarity and magnitude of the voltage applied to an electrode which is installed in the atmosphere of the positive and negative ions. Positive ions are adhered on the electrode by applying a negative voltage to the electrode, thus forming an environment with an excess of negative ions in the vicinity of the electrode; and the collecting of dust or removal of static electricity is performed by feeding the negative ions into the air or onto a static electricity charged object by a blower.

12 Claims, 7 Drawing Sheets

METHOD AND APPARATUS FOR CONTROLLING IONS

BACKGROUND OF THE INVENTION

1. Field of the Invention

The present invention relates to a method and apparatus for regulating positive ions and negative ions in a particular space.

2. Prior Art

Conventional apparatuses for regulating the ratio of positive ions and negative ions in an ionized gas include an apparatus which separately adjusts the voltages applied to the positive and negative electrodes in a corona discharge and an apparatus in which an ionized gas generated by causing a water stream to collide with a hard solid is applied to a centrifugal separator.

Furthermore, apparatuses for eliminating a static electricity zone by means of an ionized gas include those which use a corona discharge and those which use direct irradiation with X-rays or blow an ionized gas generated by X-ray irradiation.

In addition, most of apparatuses which clean air by means of an ionized gas are those which utilize a corona discharge. An apparatus which utilizes the Lenard effect is also know for this purpose, in which an ionized gas is generated by causing a water stream to collide with a hard solid.

However, apparatuses which utilize a corona discharge in order to control the mixture ratio of positive ions and negative ions involve problems with noise that is generated by the corona discharge, and such apparatuses also involve a danger of deleterious effects on the human body by the ozone and nitrogen oxide compounds generated by the discharge, as well as a danger of electrical shock and explosion. Furthermore, in the case of such apparatuses, it is not easy to control the mixture ratio of positive ions and negative ions to a desired value. Moreover, in the case of air-cleaning apparatus using a corona discharge, the cleaning effect has a narrow range.

Furthermore, the apparatus which utilizes the Lenard effect requires a mechanism which causes a high-velocity water stream to collide with a hard solid in order to generate an ionized gas and a centrifugal separator which is used to separate the ions, etc. As a result, the structure is complicated, and the overall weight tends to be large; furthermore, such a structure is susceptible to mechanical problems.

In the case of apparatuses which remove static electricity by a simple direct irradiation of X-rays or by a blowing of an ionized gas generated by X-rays onto an object, equal quantities of positive and negative ions reach the vicinity of the object. In this case, if the static electricity is on the object temporarily, this static electricity can be removed by means of equal quantities of positive and negative ions. However, if static electricity is continuously generated as in the case of rotating belts or powders jetting from nozzles, etc., problems would occur if equal quantities of positive and negative ions are supplied. In other words, since ions which have the opposite polarity from that of an object to be treated continue to be consumed, ions which have the same polarity as the object remain and are replenished, resulting in that effective removal of the static electricity becomes impossible.

SUMMARY OF THE INVENTION

Accordingly, the object of the present invention is to provide an apparatus which: ameliorates the above-described drawbacks encountered in the prior art; makes it possible to achieve effective countermeasures against static electricity (even in cases where static electricity is continuously generated) by using a simple mechanism to control the mixture ratio of positive ions and negative ions in a large quantity of an ionized gas, and makes it possible to clean air on a large scale by supplying negative ions.

More specifically, in the present invention, the ratio of positive ions and negative ions is controlled by adjusting the polarity and magnitude of a voltage applied to an electrode of an appropriate shape which is installed in an ionized gas distribution region, in which a large quantity of an ionized gas generated by X-ray irradiation is present in a stationary fashion, or in an ionized gas flow region, in which a large quantity of an ionized gas generated by X-ray irradiation moves around.

When, for example, a negative voltage is applied to the electrode in such an apparatus as described above, the electrode to which the negative voltage has been applied adheres positive ions from the surrounding area, thus making the area near the electrode an environment with an excess of negative ions. This environment with an excess of negative ions absorbs positive ions from surrounding regions so that the surrounding regions are further converted into regions with an excess of negative ions. This phenomenon is propagated in the manner of a chain reaction, so that an environment with an excess of negative ions can be formed in the overall region in which the ionized gas is distributed. Likewise, if a positive voltage is applied to the electrode, an environment with an excess of positive ions can be formed in the distribution region of the ionized gas by a phenomenon which is the opposite of that described above.

Thus, by appropriately setting the voltage applied to the electrode, it is possible to form an environment in which positive and negative ions are present in equal quantities; and it is also possible to form an environment in which only positive ions or only negative ions are present, or an environment in which ions of one polarity are present in greater quantities than ions of another polarity.

DETAILED DESCRIPTION OF THE INVENTION

Figure 1:
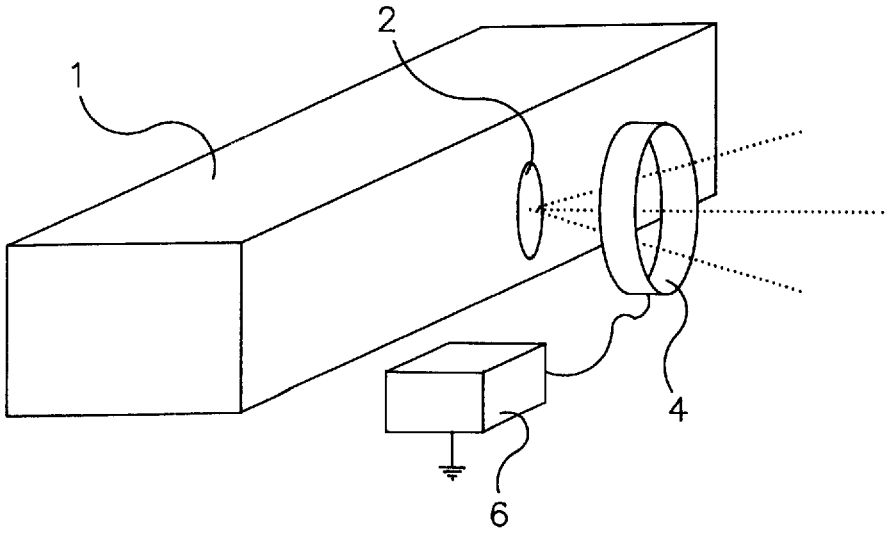
FIG. 1 is a perspective view which illustrates the basic principle of the present invention.

FIG. 1 illustrates the basic principle of the present invention. An electrode 4 is installed in the vicinity of an X-ray irradiation port 2 of an X-ray irradiation means 1. A power supply 6 is connected to the electrode 4 so that the polarity and magnitude (voltage level) of the voltage applied to the electrode 4 can be changed. A ring shape is most suitable as the shape of the electrode 4; however, as long as the X-rays from the irradiation means can pass through it, the electrode 4 can take various other shapes such as a four-sided shape, etc.

Figure 2:
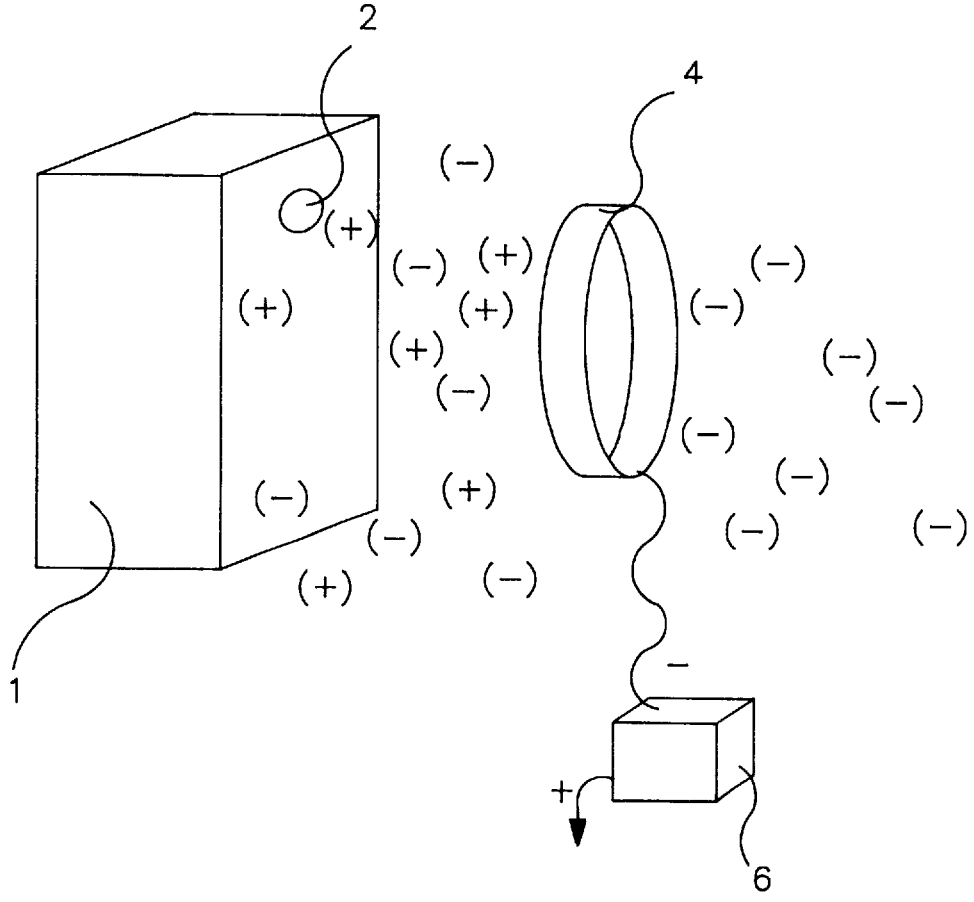
FIG. 2 is a perspective view which illustrates the operating state of the basic principle of the present invention.

Accordingly, when the X-ray irradiation means 1 is operated so that X-rays are emitted from the X-ray irradiation port 2 as indicated by the broken lines, the air in this X-ray irradiation region undergoes electrical dissociation, so that equal quantities of positive and negative ions (indicated by (+) and (−)) are generated on the left side of the electrode 4 as shown in FIG. 2. Then, when a negative voltage, for example, is applied to the ring-form electrode 4 by the power supply 6, the electrode 4 to which the negative voltage has been applied adheres positive ions from the surrounding area, resulting in that the vicinity of the electrode 4 becomes an environment with an excess of negative ions. This environment with an excess of negative ions absorbs positive ions from surrounding regions so that the surrounding regions are further converted into regions with an excess of negative ions. This phenomenon is propagated in the manner of a chain reaction, so that an environment with an excess of negative ions can be formed in the overall region in which the ionized gas is distributed, as indicated by the (−) signs, on the right side of the electrode 4 in FIG. 2.

Thus, an environment with an enriched concentration of negative ions, which is effective in the elimination of bacteria, removal of dust, and deodorization, etc., can be formed.

On the other hand, if a positive voltage is applied to the electrode 4, an environment rich in positive ions can be formed in the ionized gas distribution region by a phenomenon which is the opposite of that described above.

Figure 3:
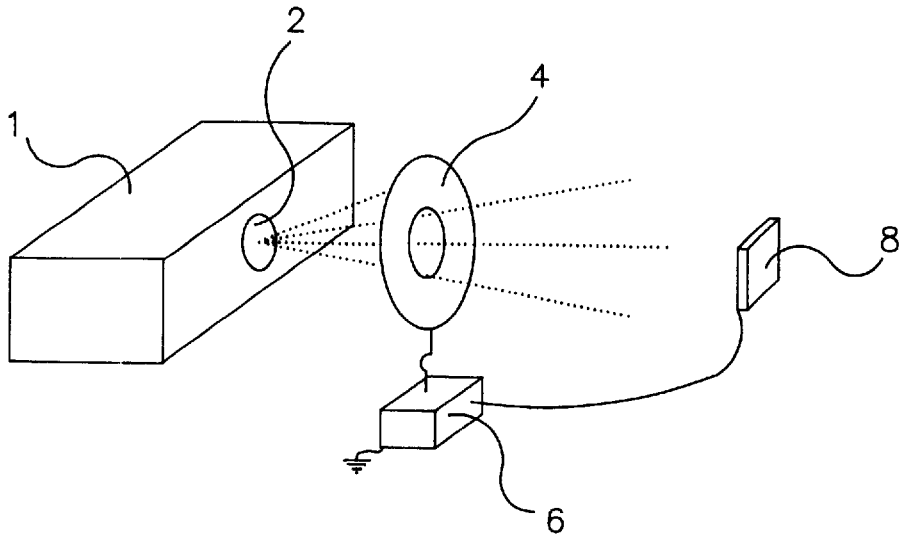
FIG. 3 is a perspective view which illustrates the basic principle of the present invention with an addition of an electrostatic sensor.

Furthermore, as shown in FIG. 3, an electrode 4 is installed in the distribution region of an ionized gas generated by X-ray irradiation effected by the X-ray irradiation means 1, and the electrode 4 is connected to a power supply 6; in addition, an electrostatic sensor 8 is disposed in the vicinity of a static electricity charged object (not shown) or in a prescribed space, and this electrostatic sensor 8 is connected to the power supply 6 so that electrostatic data detected by the sensor 8 is constantly transmitted to the power supply 6. Accordingly, the power supply 6 can appropriately control the electrode 4 in accordance with the electrostatic data (amount of static electricity) detected by the electrostatic sensor 8, changing the polarity and magnitude of the voltage applied to the electrode 4, creating an environment wherein positive and negative ions are both present in an appropriate ratio (including cases where the ratio of ions of one polarity is zero) in the vicinity of the static electricity charged object.

In this case, the X-ray irradiation region may be controlled by a metal diaphragm means 10 which is disposed in the vicinity of the electrode 4.

Figure 4:
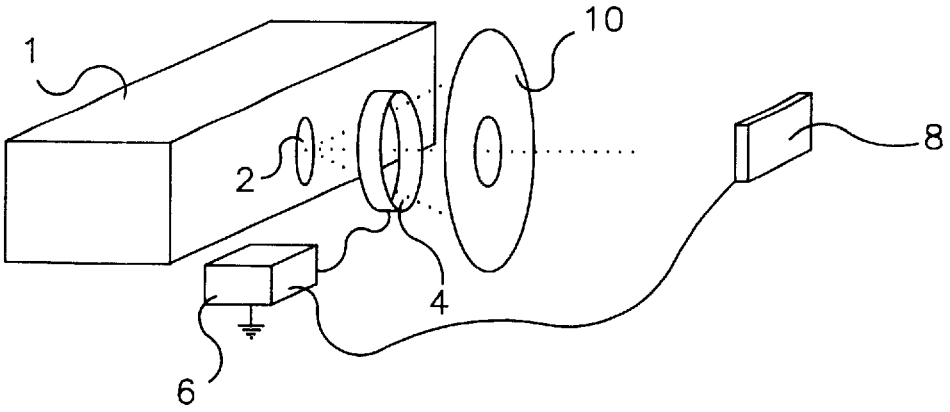
FIG. 4 is a perspective view which illustrates the basic principle of the present invention with an addition of a metal plate and an electrostatic sensor.

When an object is one of those on which static electricity is applied only temporarily, the static electricity on such an object can be removed (as described above) by setting the voltage applied to the electrode (i. e., the ion-regulating electrode) at 0 so as to form equal quantities of positive and negative ions in the vicinity of the charged object. However, in the case of, for example, a powder which is discharged from a nozzle that is formed from a conductive material and grounded, or in the case of a belt, etc., which is rotated by a pulley that is formed from a conductive material and grounded, either one of the positive and negative charges generated by friction is lost in the grounded conductive material, so that the other charge continues to appear in the powder or belt, etc. Thus, in cases where static electricity is continuously generated on a charged object, the mere creation of equal quantities of positive and negative ions in the vicinity of the charged object will result in the continued consumption of ions which are of the opposite polarity from the charged object, so that ions of the same polarity as the charged object remain and saturates. Accordingly, with the electrostatic sensor 8 provided on the charged object as shown in FIGS. 3 and 4, the ratio of positive and negative ions can be controlled in accordance with the charged state of the object, thus effectively removing the static electricity that would be continuously generated on the object.

Furthermore, such an electrostatic sensor 8 can also be useful in cases where it is necessary to impart static electricity to an object by charging a floating mist-form material to a positive or negative polarity and causing the adsorption of this material on a separate object by electrical attraction.

Figure 5:
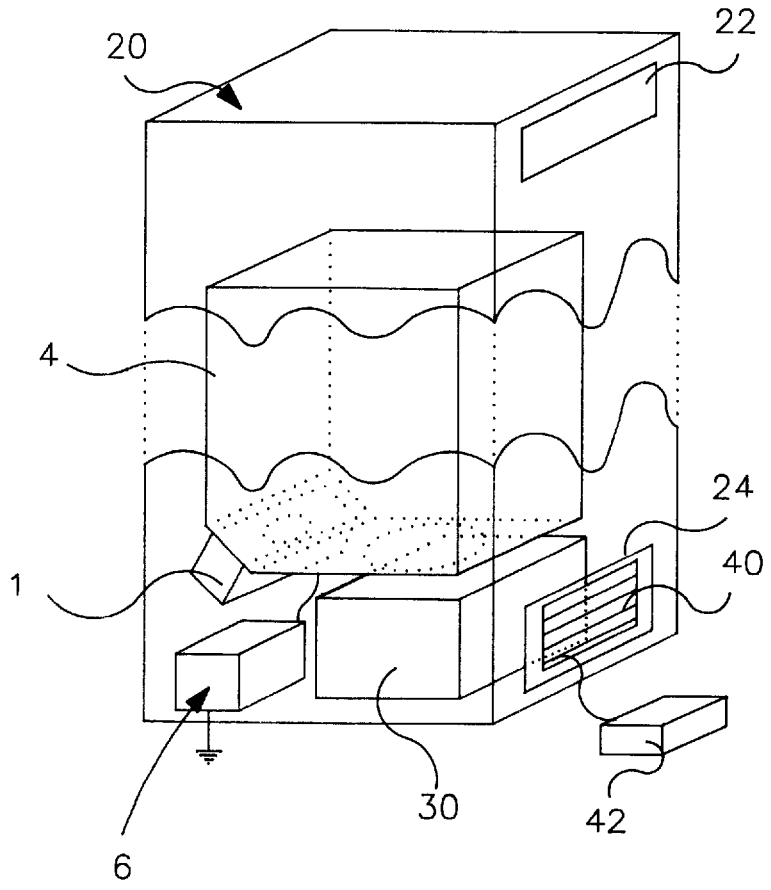
FIG. 5 is a perspective view of an embodiment of the present invention, the embodiment being a dust-collecting/air-cleaning apparatus.

FIG. 5 shows a dust-collecting apparatus that uses the principle of the present invention. In this apparatus, which is a blower system, an X-ray irradiation device and an electrode are installed inside a casing. Negative ions are released by the apparatus, and dust particles to which the released negative ions are adhered and collected, thus cleaning the air.

More specifically, an X-ray irradiation device 1 and a wind-tunnel-form electrode 4 are installed inside a metal casing 20. The wind-tunnel-form electrode 4 is a roughly cubical wind tunnel with the upper and lower end surfaces thereof open, and this electrode 4 is provided above the irradiating portion of the X-ray irradiation device 1. An electrode is installed on the inside surface of the wind tunnel. This wind-tunnel-form electrode 4 is connected to a power supply 6 which is installed inside the casing 20. Furthermore, a blower 30 is installed beneath a lower opening of the electrode 4, and an ion blow-out port 22 is formed in the upper side wall of the casing 20. Moreover, an intake port 24 is formed in the lower side wall of the casing 20, and a dust-collecting plate (filter) 40 is installed in this intake port 24. A power supply 42 for the dust-collecting plate is connected to the dust-collecting plate 40, so that a voltage can be applied to the dust-collecting plate 40.

Accordingly, a negative voltage is applied to the electrode 4 by the power supply 6 so that only negative ions are allowed to remain in the ionized gas generated by the X-ray irradiation device 1, and the blower 30 installed beneath the electrode 4 is operated so that these negative ions are discharged from the ion blow-out port 22. As a result, the negative ions adhere to dust so that the dust becomes negatively charged, and the negatively charged dust is captured by the dust-collecting plate 40 which is positively charged by the dust-collecting plate electrode 42, so that the air is cleaned.

A fan having a blower capacity of, for example, 2000 to 3500 $m^3/h$ can be used as the blower 30, and a roughly cubic stainless steel frame with dimensions of, for example, 600 mm×400 mm×500 mm can be used as the wind-tunnel-form electrode. Furthermore, a voltage of, for example, 0 to −5 kV is applied to the electrode 4 by the power supply 6 so that negative ions are extracted.

Moreover, the casing 20 is made of metal so that the leakage of X-rays to the outside of the casing 20 is prevented.

Figure 6:
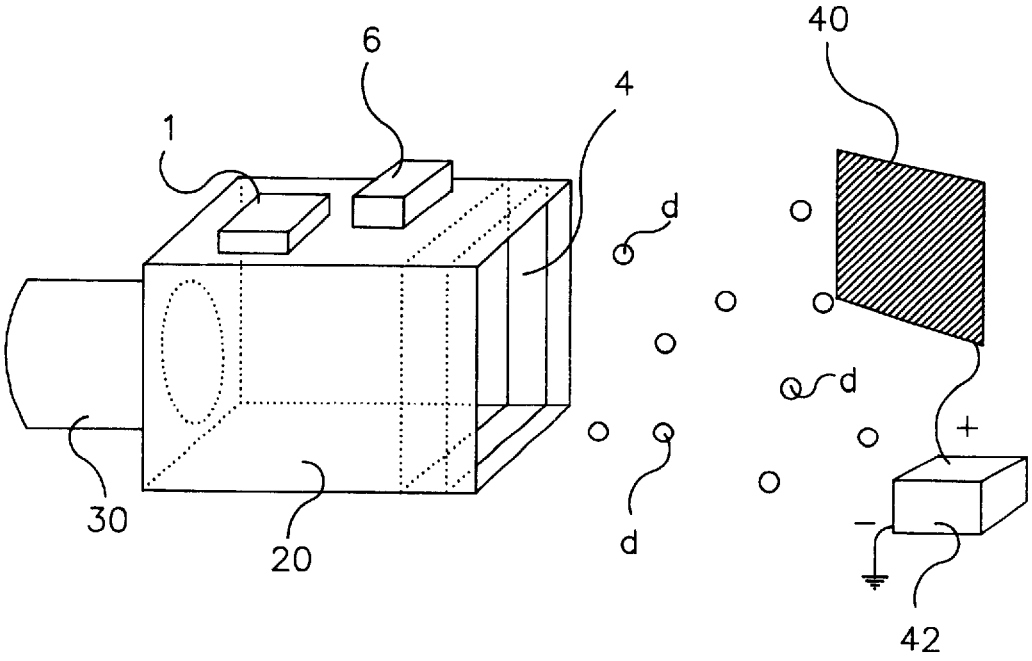
FIG. 6 is a perspective view of another embodiment of the present invention, the embodiment being a dust-collecting/air-cleaning apparatus.

FIG. 6 illustrates another embodiment of the air-cleaning apparatus shown in FIG. 5. In this apparatus, an X-ray irradiation device 1 is installed on the upper outside wall of the casing 20 so that X-ray can be irradiated to the interior of the casing 20. Furthermore, a blower 30 is installed at one end of the casing 20, and an ion-regulating electrode 4 is installed along the inside of an ion blow-out port 22 at another end of the casing 20. In addition, a power supply 6 is connected to the electrode 4. This embodiment differs from the embodiment shown in FIG. 5 in that the dust-collecting plate 40 connected to the dust-collecting plate power supply 42 is installed separately from the casing 20.

Accordingly, the X-ray irradiation device 1 is operated so that ions are generated, and a negative voltage is applied to the electrode 4 by the power supply 6 so that only negative ions are discharged from the ion blow-out port 22 of the casing 20 by the operation of the blower 30 provided at one end of the casing 20. These discharged negative ions adhere to dust d in the air so that the dust d is negatively charged and captured by the dust-collecting plate 40, which is disposed separately from the casing 20 and to which a positive voltage is applied by the dust-collecting plate power supply 42. Cleaning of the air is thus accomplished.

Figure 7:
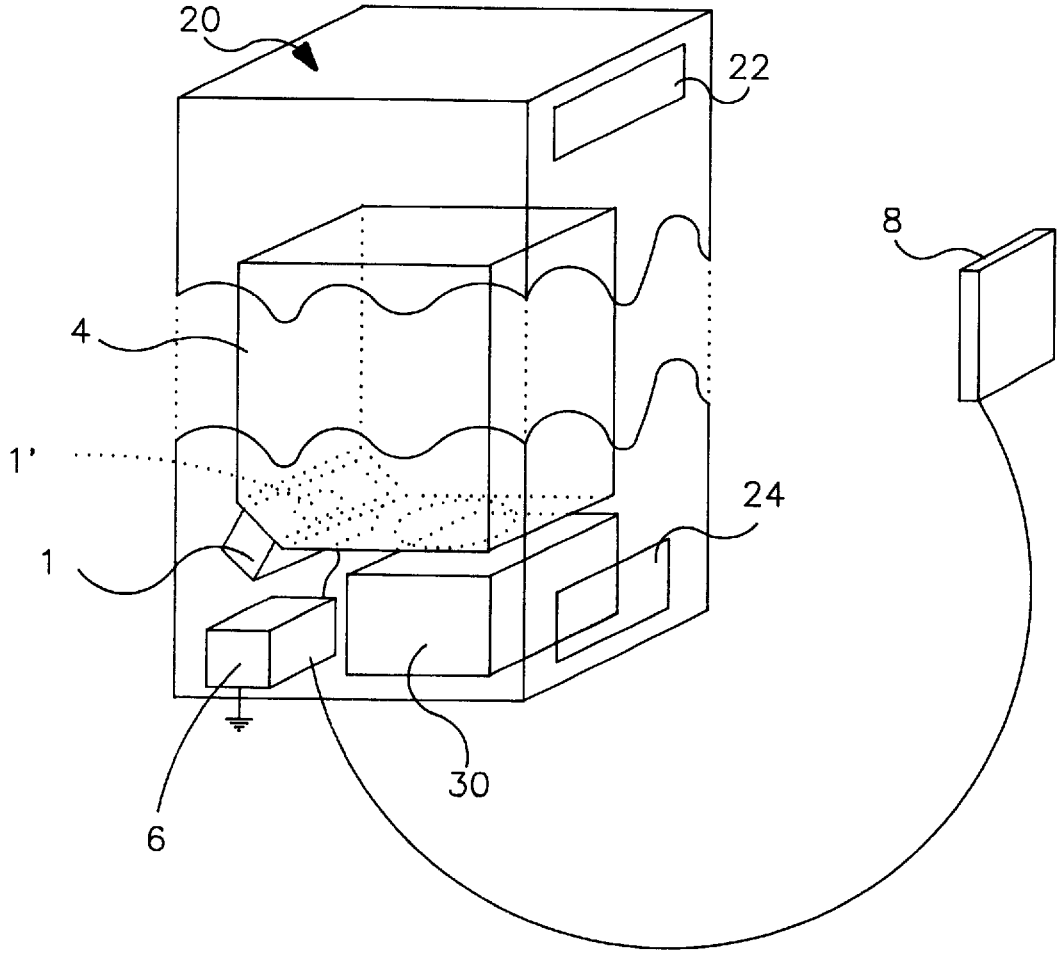
FIG. 7 is a perspective view of still another embodiment of the present invention, the embodiment being a static electricity removing/imparting apparatus.

FIG. 7 illustrates a static electricity removing/imparting apparatus which utilizes the principle of the present invention (especially that shown in FIG. 3). Here, an X-ray irradiation means and an ion-regulating electrode are installed inside a casing which has a blower system, and ions are blown onto the object to be treated. Furthermore, an electrostatic sensor is disposed on the object so that the quantity of ions is controlled according to the amount of static electricity on the object.

More specifically, an X-ray irradiation device 1 and an electrode 4 are provided inside a casing 20. The electrode 4, which has a wind tunnel shape similar to that of the electrode in the embodiment shown in FIG. 5 and is connected to a power supply 6, is installed above an irradiating part 1' of the X-ray irradiation device 1. A blower 30 is installed beneath the electrode 4. An ion blow-out port 22 is formed in the upper part of the casing 20, and an ion intake port 24 is formed in the lower part of the casing 20. Furthermore, an electrostatic sensor 8 is installed on an object to be treated, e. g., a belt (not shown) rotated by a pulley (not shown) which is made of a conductive material and grounded. Thus, the object to be treated is installed in a location away from the casing 20. In addition, the electrostatic sensor 8 is connected to the power supply 6 to which the ion-regulating electrode 4 is connected.

Accordingly, the X-ray irradiation device 1 is operated so that equal quantities of positive and negative ions are generated; then, a negative voltage is applied to the electrode 4 by the power supply 6 so that only negative ions are allowed to remain. The blower 30 installed beneath the electrode 4 is operated so as to discharge the negative ions produced as described above from the ion blow-out port 22 of the casing 20. As a result, negative ions are blown onto the object to be treated (e. g., a pulley (not shown)), which is positively charged. Since the electrostatic sensor 8 is provided on the object being treated, it is possible to successively monitor the static electricity charged state of the object and adjust the magnitude of the voltage applied to the electrode 4 via the power supply 6. Thus, a good balance can be taken so that the static electricity generated on the pulley is constantly eliminated.

Conversely, when a positive voltage is applied to the electrode 4 by the power supply 6 and the magnitude of this voltage is adjusted appropriately by the electrostatic sensor 8, it is possible to blow positive ions onto a negatively charged object, thus obtaining a good balance and eliminating the static electricity on the object. Furthermore, by appropriately adjusting the polarity and magnitude of the voltage applied to the electrode 4, it is also possible to have a specific object maintain an appropriate amount of static electricity.

Figure 8:
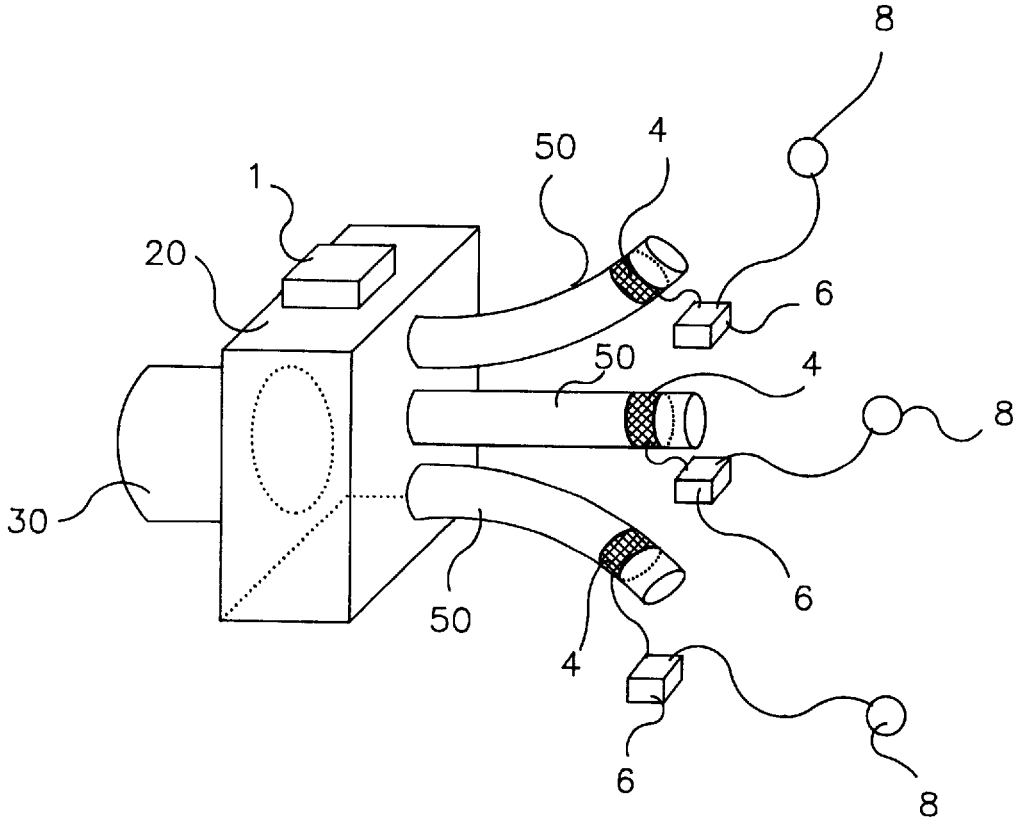
FIG. 8 is a perspective view of still another embodiment of the present invention, the embodiment being a static electricity removing/imparting apparatus.

FIG. 8 illustrates an apparatus in which a plurality of electrodes are disposed in the flow region of an ionized gas generated by X-ray irradiation so that the static electricity is removed or imparted by changing the polarities and magnitudes of the voltages applied to the respective electrodes, and the ratio of positive and negative ions is controlled in all or part of the flow region of the ionized gas.

More specifically, an X-ray irradiation device 1 and a blower 30 are installed inside a casing 20, and a plurality of ducts 50, each of which is connected to the casing 20 at one end thereof and has an opening at another end, are installed in the casing 20 as ion blow-out ports. An electrode 4 is installed in each of the ducts 50, and a power supply 6 is connected to each of these electrodes 4. Furthermore, respective electrostatic sensors 8 are installed on or in the vicinity of each of a plurality of objects to be treated (not shown), and these electrostatic sensors 8 are connected to the power supplies 6 which adjust the polarities and magnitudes of the voltages applied to the electrodes 4.

Accordingly, a large quantity of ionized gas outputted by the X-ray irradiation device 1 and blower 30 can be distributed and blown onto respective objects through the plurality of ducts 50 having electrodes 4 to which voltages of different polarities and magnitudes are applied by the respective power supplies 6. Furthermore, a gas consisting of the necessary positive and negative ions can be blown onto each object via the respective ducts 50 in accordance with the conditions of the static electricity present on or around each object, as detected by the respective electrostatic sensors 8.

It is indeed also possible to blow ions onto a single specified object by installing a single duct 50.

As in the case of the embodiment of FIG. 7, it is further possible to maintain appropriate static electricity on specific objects by appropriately changing the polarities and magnitudes of the voltages applied to the electrodes 4.

As seen from the above, in the present invention, one or more electrodes of an appropriate shape are installed in the distribution region or flow region of an ionized gas generated by X-ray irradiation and adjustment of the mixture ratio of positive and negative ions throughout the entire distribution region or flow region of the ionized gas, or in respective portions of the distribution region or flow region of the ionized gas, is accomplished in a simple and stable manner in accordance with the polarities and magnitudes of the voltages applied to the respective electrodes.

Accordingly, the present invention makes it possible to provide a safe static electricity removing apparatus which is free of the dangers associated with the production of harmful substances and with the electric shock and explosion, etc. seen in devices that utilize a corona discharge which constitute the mainstream of conventional static electricity removing apparatuses. In the present invention, furthermore, a removal of static electricity on objects that are continuously charged can be possible. Moreover, the present invention makes it possible to treat spaces which have different levels of static electricity in different positions or to perform different treatments on objects in different positions.

Furthermore, the present invention makes it possible to achieve efficient removal of dust adhered with negative ions throughout a broad space by means of a positively charged dust collector, while supplying negative ions that are considered healthful.

I claim:

1. An ion control method comprising irradiating an X-ray within a predetermined space so as to generate positive ions and negative ions, applying a voltage to an electrode disposed in an atmosphere of said positive ions and negative ions, detecting an amount of static electricity on an object which is charged with static electricity by an electrostatic center, and charging a polarity and magnitude of said voltage applied to said electrode in accordance with an amount of said detected static electricity to control a mixture ratio of said positive and negative ions to be a preset ratio.

2. An ion control method according to claim 1, wherein said applied voltage is changed in polarity and magnitude thereof.

3. An ion control method according to claim 2, wherein a negative voltage is applied to said electrode so as to adhere said positive ions on said electrode, thus creating an environment with an excess of negative ions around said electrode.

4. An ion control method according to claim 2, wherein a positive voltage is applied to said electrode so as to adhere said negative ions on said electrode, thus creating an environment with an excess of positive ions around said electrode.

5. An ion control appartus comprising:

a casting which has a blow-out port and an intake port;

an ion discharge device which is installed inside said casing, said ion discharge device comprising:

an X-ray irradiation means having an X-ray irradiating part, a wind tunnel means installed in the vicinity of said X-ray irradiation port and having openings at both ends thereof, an electrode installed inside said wind tunnel means, a power supply connected to said electrode, a blower means installed in the vicinity of said opening located at one end of said wind tunnel means; and an electrostatic sensor disposed outside said casing and connected to said power supply, said electrostatic sensor for detecting an amount of static electricity on an object which is charged with static electricity; and wherein a mixture ratio of positive ions and negative ions generated by said X-ray irradiation means is controlled to be preset ratio by changing a polarity and magnitude of a voltage applied to said electrode in response to the amount of static electricity detected by said electrostatic sensor, and said positive ions and negative ions whose mixture ratio has been controlled are discharged to outside of said casing via said blow-out port by said blower means.

6. An ion control apparatus according to claim 5, wherein said mixture ratio of either said positive ions or said negative ions is zero.

7. An ion control apparatus according to claim 6, further comprising a dust-collecting means which captures dust to which positive ions or negative ions discharged from said casing have adhered, and a power supply for said dust-collecting means which applies a positive or negative voltage to said dust-collecting means.

8. An ion control appartus comprising:

a casing which has an X-ray irradiation means and a blower means;

a duct which is disposed outside said casing, said duct being connected to said casing at one end thereof and having an opening at another end thereof;

an electrode which is installed inside said duct;

a power supply which is connected to said electrode so as to change a polarity and magnitude of a voltage applied to said electrode; and an electrostatic sensor disposed outside casing and connected to said power supply, said electrostatic sensor for detecting an amount of static electricity on an object which is charged with static electricity; and wherein positive ions and negative ions generated by said X-ray irradiation means are introduced into said duct by said blower means, and said ions are discharged from said opening of said duct after a mixture ratio of said ions has been controlled to be preset ratio by changing said polarity and magnitude of a voltage applied to said electrode by said power supply in response to the amount of static electricity detected by said electrostatic sensor.

9. An ion control apparatus according to claim 8, wherein a mixture ratio of either said positive ions or said negative ions is zero.

10. An ion control apparatus according to claim 8, wherein said duct is provided in plurality, and an electrode and a power supply are provided for each one of said plurality of ducts.

11. An ion control apparatus according to claim 10, wherein a plurality of electrostatic sensors are installed outside said plurality of ducts, and said plurality of electrostatic sensors are respectively connected to said power supplies.

12. The ion control appartus according to claim 11, further comprising a plurality of dust collecting means which captures dust to which positive ions or negative ions discharged from said casing have adhered, and a power supply for said plurality of dust collecting means which supplies a positive or negative voltage to each of said plurality of said dust collecting means.

* * * * *